US005790092A

United States Patent [19]

Moriyama

[11] Patent Number: 5,790,092

[45] Date of Patent: Aug. 4, 1998

[54] LIQUID CRYSTAL DISPLAY WITH REDUCED POWER DISSIPATION AND/OR REDUCED VERTICAL STRIPED SHADES IN FRAME CONTROL AND CONTROL METHOD FOR SAME

[75] Inventor: Hiroaki Moriyama, Tokyo, Japan

[73] Assignee: NEC Corporation, Tokyo, Japan

[21] Appl. No.: 506,705

[22] Filed: Jul. 25, 1995

[30] Foreign Application Priority Data

Jul. 28, 1994 [JP] Japan ..... 6-194593

[51] Int. Cl.[6] ..... G09G 3/36

[52] U.S. Cl. ..... 345/96; 345/209

[58] Field of Search ..... 345/87, 94, 95, 345/96, 99, 208, 209, 210

[56] References Cited

U.S. PATENT DOCUMENTS 5,093,655 3/1992 Tanioka et al. ..... 345/96

FOREIGN PATENT DOCUMENTS 4309926 11/1992 Japan .

OTHER PUBLICATIONS

N. Ikeda et al.; "Late-News Paper: High-Resolution 12.9-in. Multicolor TFT-LCD for EWS"; Society for Information Display 92 Digest, pp. 59-62. 1992.

*Primary Examiner*—Regina Liang
*Attorney, Agent, or Firm*—Whitham, Curtis & Whitham

[57] ABSTRACT

A liquid crystal display is driven so that an arbitrary pair of neighboring ones of M×N matrixed pixels in a row direction are driven by reversing a polarity of a signal potential in either thereof from that in the other thereof, an arbitrary pair of neighboring combinations of neighboring two of the M×N pixels in a column direction are driven by reversing the polarity of the signal potential in each of the neighboring two in either thereof from that in each of the neighboring two in the other thereof, and the polarity of the signal potential in each of the M×N pixels is reversed every frame. Four of the pixels in an arbitrary two-row by two-column area and four of the pixels in an arbitrary quartet of continuous rows in an arbitrary column both contain four drive phases of a pair of drive voltages.

16 Claims, 17 Drawing Sheets

(FRAME F1)

(FRAME F2)

FIG. 13A

| | | | | |
|---|---|---|---|---|
| | | P(1,2) | | |
| P(1,1) | + | − | + | − |
| P(2,1) | + | − | + | − |
| | − | + | − | + |
| | − | + | − | + |
| | + | − | + | − |
| | + | − | + | − |
| | − | + | − | + |

(FRAME F1)

FIG. 13B

| | | | | |
|---|---|---|---|---|
| | | P(1,2) | | |
| P(1,1) | − | + | − | + |
| P(2,1) | − | + | − | + |
| | + | − | + | − |
| | + | − | + | − |
| | − | + | − | + |
| | − | + | − | + |
| | + | − | + | − |

(FRAME F2)

LIQUID CRYSTAL DISPLAY WITH REDUCED POWER DISSIPATION AND/OR REDUCED VERTICAL STRIPED SHADES IN FRAME CONTROL AND CONTROL METHOD FOR SAME

BACKGROUND OF THE INVENTION

The present invention relates to a liquid crystal display and a control method for the same, and in particular, to a liquid crystal display permitting an effectively reduced power dissipation in signal generation and/or effectively reduced vertical striped shades in frame control and to a control method for the same.

DESCRIPTION OF THE RELATED ART

Recent years have observed an increasing demand for a liquid crystal display of an energy and space saving type having a wide range of applications such as to a display for a computer, e.g. a personal computer.

FIG. 1 is a block diagram of a conventional liquid crystal display of this type.

The conventional liquid crystal display comprises a liquid crystal display panel (hereafter "LCD panel") 108, a combination of a gate driver 110 and a source driver 111 for driving the LCD panel 108, and a signal processor 109 for processing an input signal is to generate a pair of control signals D10 and D11 for controlling the drivers 110 and 111, respectively. The LCD panel 108 comprises a set of matrix-arranged liquid crystal picture elements or pixels each having a thin-film transistor (hereafter "TFT") of a field effect type made of an amorphous silicon or the like and employed as a switching element.

FIG. 2 is a circuit diagram of a display area of the LCD panel 108.

The display area shown by FIG. 2 includes four of M×N pixels (where M and N are predetermined positive integers) arranged in a matrix: an upper left one P(1,1) arranged at a first one of N columns in a first one of M rows of the pixel matrix, an upper right one P(1,2) at a second column in the first row, a lower left one P(2,1) at the first column in a second row, and a lower right one P(2,2) at the second column in the second row, as well as a first and a second one of horizontally extending M gate drive conductors (hereafter each respectively "gate line") 1 and a first and a second one of vertically extending N source drive conductors (hereafter each respectively "source line") 2, the gate and source lines 1 and 2 being electrically isolated from each other at respective cross points therebetween.

An arbitrary pixel P(i,j) (not shown for i>2 and j>2) arranged at a j-th column in an i-th row of the pixel matrix is formed between not shown transparent substrate layers, where i and j are arbitrary integers such that $1 \leqq i \leqq M$ and $1 \leqq j \leqq N$, respectively.

The pixel P(i,j) comprises in an elemental sense a pixel electrode 3, an opposite electrode 7, a liquid crystal capacitor 5, a storage capacitor 6, and the TFT 4 having a gate electrode 4*a* thereof connected to an i-th gate line 1 and a source electrode 4*b* thereof connected to a j-th source line 2.

In a structural sense, the liquid crystal capacitor 5 comprises the pixel electrode 3 being formed on either substrate layer, the opposite electrode 7 being formed on the other substrate layer, and a volume of liquid crystal filled therebetween.

The opposite electrode 7 is common to all pixels P(i,j), as it is a member of the liquid crystal capacitor 5 of each pixel P(i,j) and connected to one electrode 6*a* of the storage capacitor 6 of the pixel P(i,j). The storage capacitor 6 stabilizes an imposed voltage across the crystal capacitor 5.

Each pixel P(1,j) in the first row is driven with a first gate drive signal G1; each pixel P(2,j) in the second row, with a second gate drive signal G2; and each pixel P(i,j) in the i-th row, with an i-th gate drive signal Gi (not shown for i>2).

Likewise, each pixel P(i,1) in the first column is driven with a first source drive signal S1; each pixel P(i,2) in the second column, with a second source drive signal S2; and each pixel P(i,j) in the j-th column, with a j-th source drive signal Sj (not shown for j>2).

FIG. 3 is a set of time charts of the drive signals G1, G2 and S1, S2.

The first gate drive signal G1 appears as a first scanning voltage pulse signal VG1; the second gate drive signal G2, as a second scanning voltage pulse signal VG2; and the i-th gate drive signal Gi, as an i-th scanning voltage pulse signal VGi (not shown for i>2). The scanning voltage pulse signals will be each called "scan pulse". The scan pulses arise in a well known line sequencing manner, and each have a high voltage level of +20V in an on-state or active state thereof and a low voltage level of −5V in an off-state or inactive state thereof.

In FIG. 3, defined by 1H is a duration of the scan pulse, in which each pixel in an associated row is driven. An infinite series of frames Fk (not shown for k>2, where k is an arbitrary integer), such as a first frame F1 and a second frame F2, are each defined by and between a rising edge of the first scan pulse VG1 in a certain occurrence thereof and that in a subsequent occurrence thereto, as used herein. For an i-th row, a series of relative frames may be defined by and between a rising edge of the i-th scan pulse VGi in a certain occurrence thereof and that in a subsequent occurrence thereto.

On the other hand, the first source drive signal S1 appears as a first variable voltage signal VS1; the second source drive signal S2, as a second variable voltage signal VS2; and the j-th source drive signal Sj, as a j-th variable voltage signal VSj (not shown for j>2). The variable voltage signals will be each called "image signal". The image signals each have a transient voltage level representative of a processed image data for the liquid crystal, substantially within a range of 0V to +10V, i.e., 5V±5V. The image data may comprise a chromatic or monochromatic data and a luminance data which may include a gray background component.

A common reference voltage VCOM of approx. 5V is applied to the opposite electrode 7. With respect to the reference voltage VCOM, the level of the second image signal VS2 in any 1H duration is opposite or reversed in polarity to or from that of the first image signal VS1 in the 1H duration; and likewise the level of a j+1-th image signal $VS_{j+1}$ in any 1H duration is reversed in polarity from that of the j-th image signal VSj in the 1H duration.

Further, between any pair of adjacent frames, the level of a j-th image signal VSj at an i-th 1H duration in either frame is reversed in polarity from that of the j-th image signal VSj at an i-th1H duration in the other frame. For example, the first image signal VS1 has a positive polarity while the first scan pulse VG1 is kept on in the first frame F1, and has a negative polarity while the scan pulse VG1 is kept on in the second frame F2.

Referring again to FIG. 1, the input signal Is includes necessary signals such as an original image signal and a synchronizing signal consisting of clocks. The signal processor 109 processes them to generate a set of corresponding signals including a gate driver control signal, a source driver control signal and N image signals VS1 to $VS_N$. These signals are selectively output to the gate driver 110, as the control signal D10 which includes the gate driver control signal, and to the source driver 111, as the control signal D11 which includes the source driver control signal and the N image signals. The gate driver control signal may include any of M scan pulses VG1 to $VG_M$.

The gate driver 110 responds to the control signal D10 to sequentially output M scan pulses VG1 to $VG_M$, in a synchronized manner. The source driver 111 responds to the control signal D11 to output the N image signals VS1 to $VS_N$ in parallel and in a synchronized manner.

Referring again to FIGS. 2 and 3, as an i-th scan pulse VGi on an i-th gate line 1 becomes active at an i-th 1H duration in a k-th frame Fk, the TFT 4 of each pixel P(i,j) in the i-th row turns on. In synchronism therewith, N image signals VS1 to $VS_N$ generated for the i-th 1H duration in the frame Fk are applied to the N source lines, so that in each pixel P(i,j) in the i-th row the crystal capacitor 5 as well as the storage capacitor 6 has stored or written therein a quantity of charges proportional to the voltage level of a corresponding one VSj of the N image signals, with an equivalent potential as a capacitor voltage level (hereafter "VLC") developed at the pixel electrode 3 relative to the opposite electrode 7.

As the scan pulse VGi becomes inactive, the TFT 4 of each pixel P(i,j) in the i-th row turns off, with the charges held as they were stored in the capacitors 5 and 6, thus keeping the potential VLC, which exerts an electric effect onto the liquid crystal, which is thereby opto-anisotropically driven with a characteristic delay to let therethrough a controlled flux of transparent rays of light representative of a dot of image.

After a lapse of a frame period, i.e. at an i-th 1H duration in a k+1-th frame $F_{k+1}$, as the scan pulse VGi again becomes active, each pixel P(i,j) in the i-th row has a corresponding one VSj of current N image signals written therein with an equivalent potential VLC reversed in polarity from the previous potential. As the opposite electrode 7 has a common potential, each written signal has the same polarity as the current image signal VSj has to the reference voltage VCOM.

Like this, each written image signal VSj has a polarity thereof alternately reversed every frame, i.e., every write action thereof, thus driving an associated liquid crystal in an alternating current driven manner, to thereby secure a long service life.

In synchronism with such an alternating action, varieties of image signals are each respectively converted into a correspondent flux of transparent light at each pixel P(i,j) in the LCD panel 108, of which the entirety is thus permitted to serve as a screen for displaying a transient scene of an extent of an original image.

In the conventional display described, a typical dot mode polarity reversion is performed, every dot every frame, over the extent of the LCD panel 108.

FIGS. 4A and 4B are polarity maps of a display area of another conventional liquid crystal display, respectively.

This conventional display also employs a typical dot mode polarity reversion method for driving a pixel matrix thereof, i.e. a polarity reversion method discussed in a Late-News Paper: "High-Resolution 12.9-in. Multicolor TFT-LCD for EWS" by N. Ikeda, H. Moriyama, H. Uchida, S. Nishida, K. Mitsuhashi, O. Matsuo, S. Kaneko, and K. Mizuno, NEC Corp., Kawasaki, Japan, in the SID (Society for Information Display) 92 DIGEST, pp. 59–62.

In this method, as shown in FIG. 4A for a certain frame, an arbitrary pixel P(i,j) has a polarity (eg. "+") different from a polarity (to be "−") of each of four pixels P(i, j−1), P(i, j+1), P(i−1, j) and P(i+1, j) neighboring thereto in the same row or the same column. Respective pixels on extensions of both diagonal lines of the pixel P(i,j), such as a one-row one-column off pixel P(i+1, j+1), each have the same polarity (i.e. "+") as a matter of course.

Then, in a subsequent frame, as shown in FIG. 4B, each pixel has a reversed polarity.

Such the typical conventional method provides a high picture quality. Even in a case of a common or opposite electrode with a relatively high resistance, the polarity reversion between a pair of neighboring source lines does not need a charge transfer from either of an associated pair of neighboring pixels to another beyond the other. Accordingly, charge transfers are counterbalanced in the entirety of an LCD panel, without causing a horizontal crosstalk.

Moreover, in the conventional method in which a pair of image signals opposite in polarity to each other are applied to any pair of neighboring pixels, each pixel has a flicker thereof geometrically cancelled by flicker components of neighboring pixels and hence the flicker is inconspicuous.

Further, in the conventional method in which a charge transfer is limited substantially between neighboring pixels, the common electrode has a reduced tendency to discharge to external circuitry, thus permitting a common voltage generator to be less power consumable.

However, in the conventional method, a polarity reversion is performed at intervals of a 1H duration, which is of an order substantially between 30 μs to 40 μs in a typical personal computer or the like, in addition to that each 5±5V image signal needs a signal amplitude of 10V in the case of the display of FIG. 1, thus resulting in an insufficient reduction of power dissipation such as at a signal processor and a source driver.

In this concern, there are known liquid crystal displays in which a dot mode polarity reversion is performed in a different manner.

FIG. 5 is a circuit diagram of a display area of a conventional liquid crystal display disclosed in the Japanese Patent Application Laid-Open Publication No. 4-309926.

In this conventional display, an arbitrary i-th gate line (not shown for i>4) is connected in a zigzag pattern, i.e., it supplies a scan pulse to every other pixel, e.g. each odd numbered one P(i, 2s−1) (not shown for s>2), in an i-th row and every other pixel, e.g. each even numbered one P(i−1, 2s) (not shown for s>2) in a neighboring i−1-th (or otherwise i+1-th) row, where s is an arbitrary element of a sequence of positive integers, to provide a flicker-less high quality image in a frame with a reduced number of undesirable horizontal and/or vertical striped shades.

In other words, among N pixels P(i,1) to P(i,N) in an i-th row, each odd numbered one P(i, 2s−1) has a TFT 4 thereof connected at a gate thereof to an i-th gate line and each even numbered one P(i, 2s) has a TFT 4 thereof connected at a gate thereof to an i+1-th gate line.

Therefore, in an i-th 1H duration in an arbitrary frame, the TFT 4 of each odd numbered pixel P(i, 2s−1) turns on to have a 2s−1-th image signal written in the pixel P(i, 2s−1) with an associated polarity. Then, in an i+1-th 1H duration in the same frame, the TFT 4 of each even numbered pixel P(i, 2s) turns on to have a 2s-th image signal written in the pixel P(i, 2s) with an associated polarity.

The polarity of the 2s-th image signal in the i+1-th duration is opposite to that of the 2s-th image signal in the i-th duration, which is reversed from the polarity of the 2s−1-th image signal in the i-th duration, so that the neighboring pixels P(i, 2s−1) and P(i, 2s) in the same row have the same polarity to each other in an arbitrary frame, while corresponding pixels P(i±1, 2s−1) and P(i±1, 2s) in each neighboring row each have an opposite polarity thereto in the same frame.

Accordingly, the conventional display of FIG. 5 apparently performs a line mode polarity reversion accompanying visually inconspicuous dot mode striped shades, and is free from disturbant line mode striped shades.

However, in this conventional display, in an arbitrary i-th 1H duration, all odd numbered pixels P(i, 2s−1) in an i-th row have the TFT's 4 thereof turned on to receive corresponding image signals of a polarity, without an opposite polarity inserted, thus causing a crosstalk.

Incidentally, there are known liquid crystal displays in which a dot mode polarity reversion is employed in combination with a frame mode control for displaying an intermediate tone of luminance (hereafter "frame control" or "FRC"). The FRC is a measure for displaying a piece of image with an alternately selected one of a pair of different luminances, to thereby represent an intermediate tone therebetween.

In an application, the FRC may be employed to pursue an unfinished goal of providing a screen with a uniform gray background. In a practical operation, a set of drive signals for FRC may be superimposed on a set of image signals, by modulating the latter with the former, under a restricted condition to abide by a polarity reversion requirement that is inherent to the liquid crystal which exhibits a delayed response.

FIG. 6 is a set of time charts of neighboring two of N parallel drive signals for a conventional FRC of an M×N pixel matrix.

As shown in FIG. 6, each drive signal has a temporary voltage level representing either of a pair of alternately selectable different luminances, with an associated polarity relative to a reference voltage VCOM.

More specifically, a first drive signal VP1 of a two-frame cycle has, in a first cycle thereof, a relatively small first voltage with a positive polarity in a first frame F1 corresponding to a first phase ① of the signal VP1 and a relatively large first voltage with a negative polarity in a second frame F2 corresponding to a second phase ② of the signal VP1 and, in an arbitrary s-th cycle thereof (not shown for s>2), a relatively small s-th voltage (that may be equivalent to the first positive voltage) with a positive polarity in a 2s−1-th frame $F_{2s-1}$ corresponding to the phase ① of VP1 and a relatively large s-th voltage (that may be equivalent to the first negative voltage) with a negative polarity in a 2s-th frame $F_{2s}$ corresponding to the phase ② of VP1. The first and second phases ① and ② are characterized by their associated polarities so that the drive signal VP1 may have a relatively large positive voltage in the first phase ① and a relatively small negative voltage in the second phase ②.

A second drive signal VP2 of the two-frame cycle has, in a first cycle thereof, a relatively small first voltage (equivalent to the first positive voltage of VP1) with a negative polarity in a first frame F1 corresponding to a first phase ③ of the signal VP2 and a relatively large first voltage (equivalent to the first negative voltage of VP1) with a positive polarity in a second frame F2 corresponding to a second phase ④ of the signal VP2 and, in an arbitrary s-th cycle thereof (not shown for s>2), a relatively small s-th voltage (equivalent to the s-th positive voltage of VP1) with a negative polarity in a 2s−1-th frame $F_{2s-1}$ corresponding to the phase ③ of VP2 and a relatively large s-th voltage (equivalent to the s-th negative voltage of VP1) with a positive voltage in a 2s-th frame $F_{2s}$ corresponding to the phase ④ of VP2. The phases ③ and ④ are also characterized by their associated polarities so that the drive signal VP2 may have a relatively large negative voltage in the phase ③ and a relatively small positive voltage in the phase ④.

In the N drive signals for the M×N pixel matrix, each 2s−1-th drive signal $VP_{2s-1}$ (not shown for s>1) comprises the first drive signal VP1, and each 2s-th drive signal $VP_{2s}$ (not shown for s>1) comprises the second drive signal VP2.

Each drive signal $VP_{2s-1}$ (or $VP_{2s}$) is phase-reversible by applying a later-described polarity determining pulse signal (hereafter "polarity signal") so that the phases ① and ② (or (③ and ④) are replaced with each other.

FIGS. 7A and 7B show phase distribution maps on a display area in the FRC by the drive signals of FIG. 6, for the first and second frames F1 and F2, respectively.

As shown in FIG. 7A for the first frame F1, the N drive signals ordered in parallel, as they are numbered from the first to an N-th, are phase-controlled by the polarity signal and applied via N source lines, in synchronism with sequential M scan pulses supplied to M gate lines so that, in a first 1H duration of the frame F1, each odd numbered pixel P(1, 2s−1) (not shown for s>2) in a first row has a VLC corresponding to the first phase ① of the 2s−1-th drive signal $VP_{2s-1}$ and each even numbered pixel P(1, 2s) (not shown for s>2) in the first row has a VLC corresponding to the first phase ③ of the 2s-th drive signal $VP_{2s}$. In a second 1H duration of the frame F1, the N drive signals are phase-reversed so that each odd numbered pixel P(2, 2s−1) (not shown for s>2) in a second row has a VLC corresponding to the second phase ② of the signal $VP_{2s-1}$ and each even numbered pixel P(2, 2s) (not shown for s>2) in the second row has a VLC corresponding to the second phase ④ of the signal $VP_{2s}$.

As shown in FIG. 7B, in a first 1H duration of the second frame F2, the phase-controlled N drive signals are applied so that the odd numbered pixel P(1, 2s−1) in the first row has a VLC corresponding to the second phase ② of the signal $VP_{2s-1}$ and the even numbered pixel P(1, 2s) in the first row has a VLC corresponding to the second phase ④ of the signal $VP_{2s}$. In a second 1H duration of the frame F2, the N drive signals are phase-reversed so that the pixel P(2, 2s−1) has a VLC corresponding to the first phase ① of the signal $VP_{2s-1}$ and the pixel P(2, 2s) has a VLC corresponding to the first phase ③ of the signal $VP_{2s}$.

In a 2s−1-th 1H duration of an arbitrary k-th frame Fk, a 2s−1-th row of the pixel matrix has the same phase distribution pattern as the first row, and in a 2s-th 1H duration of the frame Fk, a 2s-th row of the pixel matrix has the same phase distribution pattern as the second row.

Incidentally, FIG. 8 is a schematic circuit diagram of a conventional polarity signal generator applicable to a phase control of the drive signals of FIG. 6, and FIG. 9 is a set of time charts describing a number of principal signals of the polarity signal generator.

The conventional polarity signal generator comprises a pair of D-type flip-flops 112 numbered either "FF4" and the other "FF5" for identification, and an exclusive logical sum circuit (hereafter "EXOR circuit") 113.

The flip-flop FF4 halves a frequency of a frame clock employed as a vertical synchronizing pulse VS, to output a half-frequency pulse. The flip-flop FF5 halves a frequency of a line clock employed as a horizontal synchronizing pulse HS, to output another half-frequency pulse. The EXOR circuit 113 determines an EXOR between the half-frequency pulses, to output a corresponding pulse signal as a polarity signal POL2 that has a polarity thereof reversed, i.e. a pair of polarity representative voltage levels alternately selected, at intervals of a 1H duration and a signal phase thereof reversed at intervals of one frame.

Referring again to FIGS. 7A and 7B, the respective pixels P(i,j) in the phase maps have their VLC's with associated polarities.

In an arbitrary synchronized cycle of the N drive signals, any pair of positive and negative VLC's neighboring each other in a row or column have their polarities different from each other and each represent in the phase ① or ③ either of a pair of different luminances and in the phase ② or ④ the other thereof, to thereby represent an intermediate luminance therebetween.

Each pixel alternately selects the two different luminances in each two-frame period, giving rise to flickers with components in terms of period (or equivalent frequency of occurrence) substantially equal to the two-frame period. For example, in the case of a frame of 16.7 msec in period (or 60 Hz in frequency), the flickers have a component about 33.3 msec (or 30 Hz).

Flicker components under 50 Hz are visible. A unified driving of whole pixels by a single drive signal may well give rise to conspicuous flicker components, resulting in a degraded display quality.

To geometrically offset such flicker components each other, the conventional FRC has employed the two drive signals VP1 and VP2 and supplied them to an LCD panel in a mixing manner so that a requisite phase combination including all of the four phases ①② and ③④ can be found within any area of a two-row by two-column size over an entirety of a pixel matrix, without causing any pair of neighboring pixels in row or column to be co-phased, while permitting a dot mode polarity reversion.

However, as will be seen from FIGS. 7A and 7B, the conventional implementation has assigned the N drive signals to N columns of the M×N pixel matrix in a one to one correspondent manner. For example, each pixel (i,1) in a first column shown by an arrow "a" has no more than a VLC associated with the phase ① or ② of the first drive signal VP1. Each pixel (i,2) in a second column shown by an arrow "b" also has no more than a VLC associated with the phase ③ or ④ of the second drive signal VP2.

The first and second drive signals VP1 and VP2, which are applied for the FRC, each provide an intermediate tone. The intermediate tone by the signal VP1 and that by the signal VP2 ideally should be identical to each other, but practically have a delicate difference to each other caused by a deviation of the reference voltage VCOM due such as to parasitic capacitances distributed in associated pixel circuits.

As a result, a conspicuous vertical striped shade still tends to be observed between 2s−1-th and 2s-th columns in an FRC display.

The present invention has been achieved with such points in mind.

SUMMARY OF THE INVENTION

It is therefore an object of the present invention to provide a liquid crystal display permitting an effectively reduced power dissipation in signal generation and/or effectively reduced vertical striped shades in frame control, as well as a control method for the same.

To achieve the object, a genus of the present invention provides a liquid crystal display comprising a display means and a control means.

The display means consists of a matrix of pixels each having a common reference potential developed therein.

The drive means drives the display means so that an arbitrary pair of neighboring ones of the pixels in a row direction of the matrix are driven by reversing a polarity of a signal potential in either thereof from that in the other thereof relative to the reference potential, an arbitrary pair of neighboring combinations of neighboring two of the pixels in a column direction of the matrix are driven by reversing the polarity of the signal potential in each of the neighboring two in either thereof from that in each of the neighboring two in the other thereof, and the polarity of the signal potential in each of the pixels is reversed every frame.

According to the genus of the invention, a signal potential which serves as an image signal has a polarity reversion period thereof doubled from a 1H duration to a 2H duration so that the polarity reversion of a tone representative voltage is extended, thus permitting a reduced power dissipation.

According to a species of the genus of the invention, the polarity of the signal potential is reversed depending on an exclusive logical sum between a half-frequency signal of a vertical synchronizing signal of the display means and a fourth-frequency signal of a horizontal synchronizing signal of the display means.

According to another species of the genus of the invention, the display means comprises a first transparent insulating substrate member, a second transparent insulating substrate member opposing the first substrate member, M gate lines arranged in parallel with each other on the first substrate member, where M is a predetermined positive integer, N source lines arranged in parallel with each other on the first substrate member, where N is a predetermined positive integer, the M gate lines and the N source lines crossing with each other in an electrically isolated manner and cooperating with each other to have therebetween M×N cross points and to define therebetween M×N enclosed areas associated with the M×N cross points in a one to one correspondent manner, and the matrix of the pixels having M rows and N columns. Each pixel comprises a thin film transistor formed in a vicinity of one of the M×N cross points, a pixel electrode formed in one of the M×N enclosed areas corresponding to said one of the M×N cross points, the pixel electrode being chargeable to have the signal potential developed thereon, an opposite electrode formed on the second substrate member, the opposite electrode being charged to have a reference potential developed thereon, and a liquid crystal filled between the first and second substrate members, the liquid crystal being responsive to the signal potential.

Moreover, to achieve the object, another genus of the present invention provides a liquid crystal display comprising a display means and a control means.

The display means consists of a matrix of pixels each having a common reference potential developed therein.

The drive means drives the display means so that the pixels are each respectively supplied with alternately selected one of a first drive voltage having a pair of drive phases thereof associated either with a relatively small voltage with a positive polarity relative to the reference voltage and the other with a relatively large voltage with a negative polarity relative to the reference voltage and a second drive voltage having a pair of drive phases thereof associated either with the relatively small voltage with the negative polarity and the other with the relatively large voltage with the positive polarity to thereby display an intermediate tone, four of the pixels in an arbitrary two-row by two-column area of the matrix and four of the pixels in an arbitrary quartet of continuous rows in an arbitrary column of the matrix both contain both the pair of drive phases of the first drive voltage and the pair of drive phases of the second drive voltage.

According to this genus of the invention, a pair of FRC drive signals supplied to a plurality of matrix arranged pixels have a devised combination of their pairs of drive phases so that four pixels in an arbitrary two-row by two-column area of a pixel matrix contain all of four phases of the drive signals and four pixels in an arbitrary quartet of continuous rows in an arbitrary column of the matrix also contain the four phases. Accordingly, four associated voltage patterns are uniformly distributed, thus permitting a uniform display with an improved quality.

According to a species of this genus of the invention, any pair of neighboring ones of the pixels in an arbitrary row or an arbitrary column of the matrix contain different two of all of the drive phases of the first drive voltage and the drive phases of the second drive voltage.

According to another species of this genus of the invention, an arbitrary pair of neighboring ones of the pixels in an arbitrary row of the matrix are driven either by the first drive voltage with either of the positive and negative polarities and the other by the second drive voltage with the other thereof, an arbitrary pair of neighboring pairs of neighboring ones of the pixels in an arbitrary column of the matrix are driven either by one of the first and second drive voltages with either of the positive and negative polarities and the other by said one of the first and second drive voltages with the other thereof, and the pixels are each respectively driven by either of the first and second drive voltages with the positive and negative polarities reversed therebetween every frame.

According to another species of this genus of the invention, the first and second drive voltages have the positive and negative polarities reversed therebetween depending on an exclusive logical sum between a half-frequency signal of a vertical synchronizing signal of the display means and a fourth-frequency signal of a horizontal synchronizing signal of the display means.

Further, to achieve the object, another genus of the present invention provides a control method for driving a liquid crystal display including a display means consisting of a matrix of pixels. The method comprises two steps.

A first step has a common reference potential developed in each of the pixels.

A second step drives the display means so that an arbitrary pair of neighboring ones of the pixels in a row direction of the matrix are driven by reversing a polarity of a signal potential in either thereof from that in the other thereof relative to the reference potential, an arbitrary pair of neighboring combinations of neighboring two of the pixels in a column direction of the matrix are driven by reversing the polarity of the signal potential in each of the neighboring two in either thereof from that in each of the neighboring two in the other thereof, and the polarity of the signal potential in each of the pixels is reversed every frame.

Still more, to achieve the object, another genus of the present invention provides a control method for driving a liquid crystal display including a display means consisting of a matrix of pixels. The method comprises two steps.

A first step has a common reference potential developed in each of the pixels.

A second step drives the display means so that the pixels are each respectively supplied with alternately selected one of a first drive voltage having a pair of drive phases thereof associated either with a relatively small voltage with a positive polarity relative to the reference voltage and the other with a relatively large voltage with a negative polarity relative to the reference voltage and a second drive voltage having a pair of drive phases thereof associated either with the relatively small voltage with the negative polarity and the other with the relatively large voltage with the positive polarity to thereby display an intermediate tone, four of the pixels in an arbitrary two-row by two-column area of the matrix and four of the pixels in an arbitrary quartet of continuous rows in an arbitrary column of the matrix both contain both the pair of drive phases of the first drive voltage and the pair of drive phases of the second drive voltage.

According to any genus of the invention described, a liquid crystal display is permitted to have a reduced power dissipation.

BRIEF DESCRIPTION OF THE DRAWINGS

The objects, features and advantages of the present invention will become more apparent from consideration of the following detailed description, taken in conjunction with the accompanying drawings, in which:

FIGS. 13A and 13B are polarity maps of a display area of the LCD panel of the display of FIG. 10, respectively;

DESCRIPTION OF THE PREFERRED EMBODIMENTS

There will be detailed below preferred embodiments of the present invention, with reference to FIGS. 10 to 17. Like members or items are designated by like characters throughout the specification and the accompanying drawings, for a brevity of the description.

Figure 10:
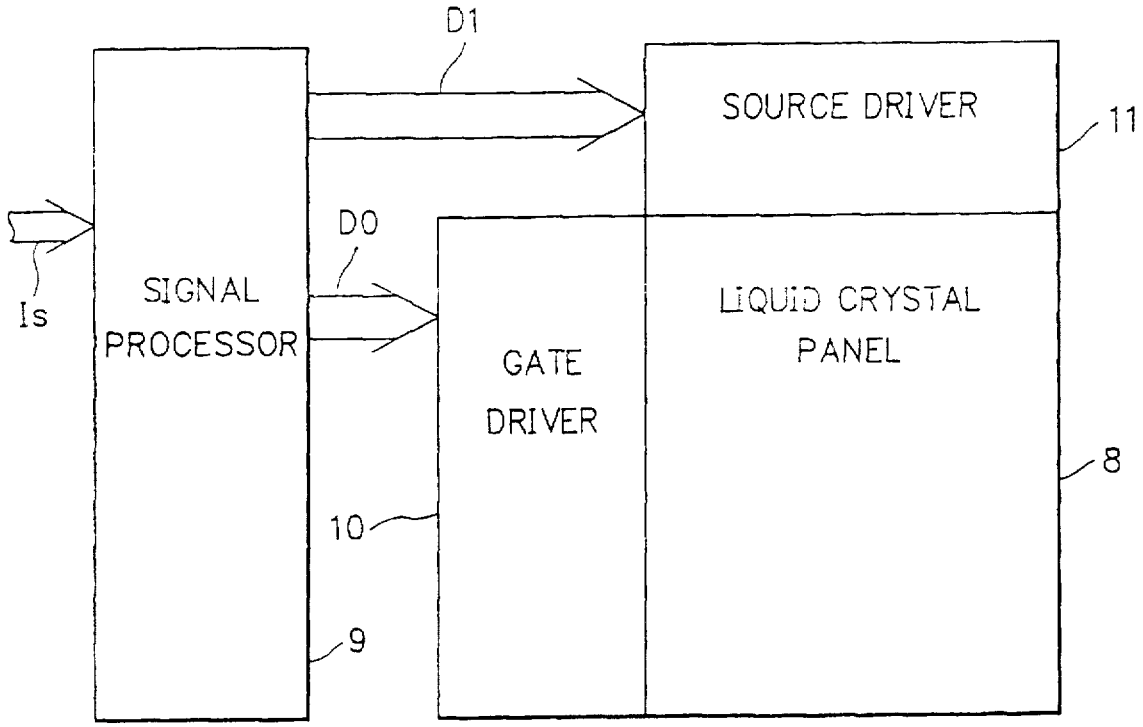
FIG. 10 is a block diagram of a liquid crystal display according to an embodiment of the invention.

FIG. 10 is a block diagram of a liquid crystal display according to an embodiment of the invention.

Figure 1:
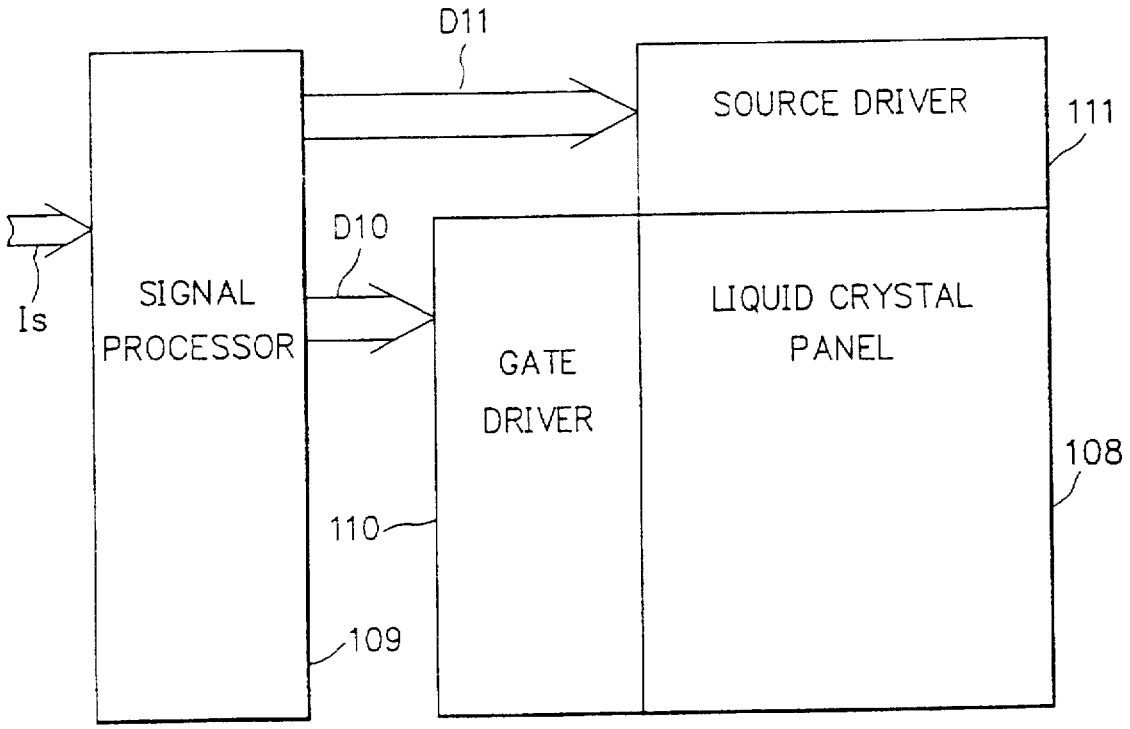
FIG. 1 PRIOR ART
FIG. 1 is a block diagram of a conventional liquid crystal display.

This liquid crystal display has a similar arrangement to the conventional display of FIG. 1. Namely, it comprises an LCD panel 8, a combination of a gate driver 10 and a source driver 11 for driving the LCD panel 8, and a signal processor 9 for processing an input signal Is to generate a pair of control signals D0 and D1 for controlling the drivers 10 and 11, respectively. The LCD panel 8 comprises a set of matrix-arranged liquid crystal pixels each having a TFT of a field effect type made of an amorphous silicon and employed as a switching element.

Figure 11:
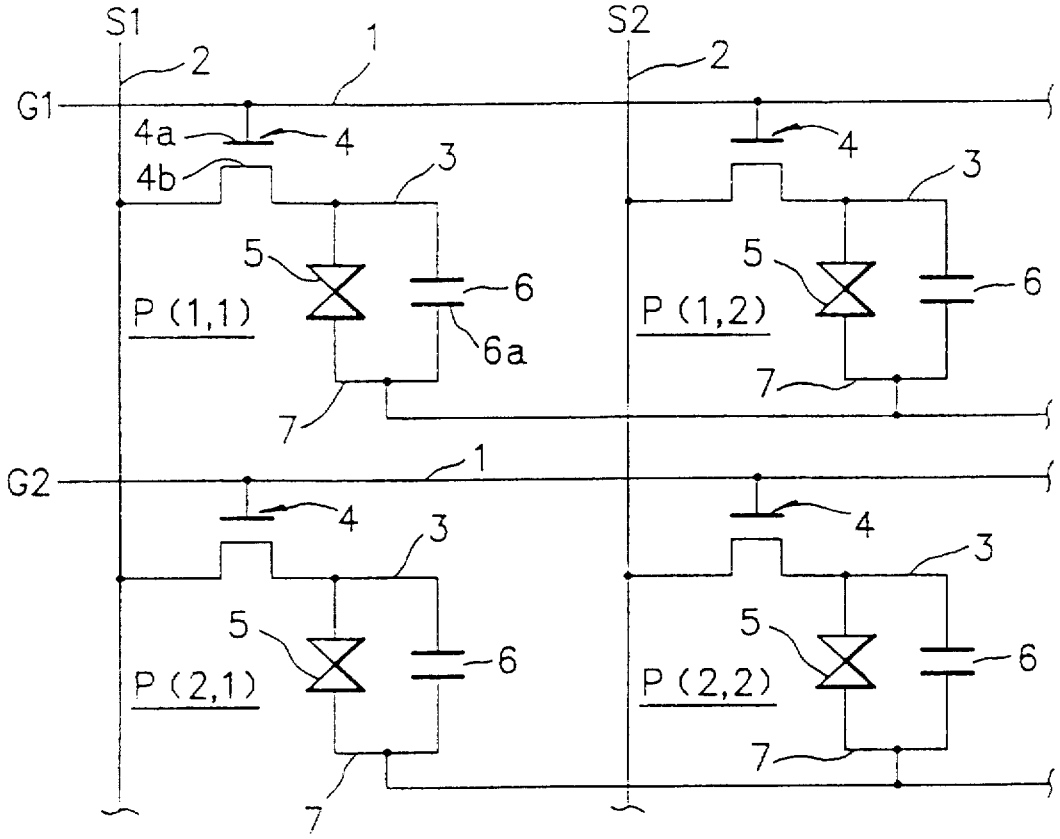
FIG. 11 is a circuit diagram of a display area of an LCD panel of the display of FIG. 10.

FIG. 11 is a circuit diagram of a display area of the LCD panel 8.

The display area shown by FIG. 11 includes four of M×N pixels arranged in a matrix: an upper left one P(1,1), an upper right one P(1,2), a lower left one P(2,1) and a lower right one P(2,2), as well as a first and a second one of horizontally extending M gate lines 1 and a first and a second one of vertically extending N source lines 2. The gate and source lines 1 and 2 are electrically isolated from each other at respective cross points therebetween.

The M gate lines and the N source lines cross each other to have M×N cross points therebetween and to define M×N enclosed areas with a one to one correspondence to the M×N cross points.

An arbitrary pixel P(i,j) (not shown for i>2) arranged in a j-th column in an i-th row of the pixel matrix is formed between not shown transparent insulating substrate members or layers. Like the case of FIG. 2, the pixel P(i,j) comprises in an elemental sense a pixel electrode 3, an opposite electrode 7, a liquid crystal capacitor 5, a storage capacitor 6, and the TFT 4 having a gate electrode 4*a* thereof connected to an i-th gate line 1 and a source electrode 4*b* thereof connected to a j-th source line 2. In a structural sense, the liquid crystal capacitor 5 comprises the pixel electrode 3 formed on either substrate layer, the opposite electrode 7 formed on the other substrate layer, and a volume of liquid crystal filled therebetween. The opposite electrode 7 is common to all pixels P(i,j) and connected to one electrode 6*a* of the storage capacitor 6 of the pixel P(i,j).

Each pixel P(i,j) in the i-th row is driven with an i-th gate drive signal Gi (not shown for i>2), and each pixel P(i,j) in the j-th column is driven with a j-th source drive signal Sj (not shown for i>2).

Figure 12:
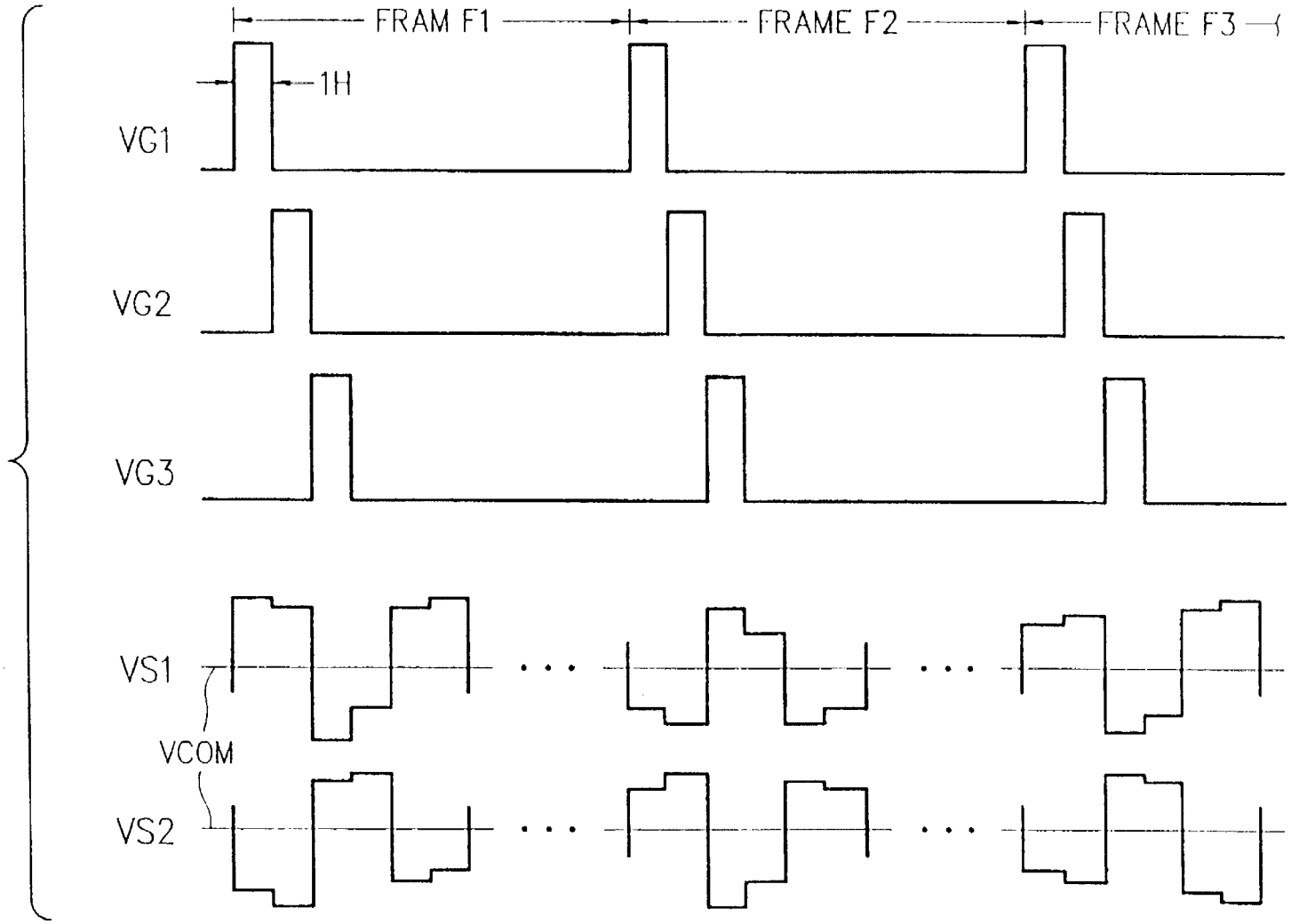
FIG. 12 is a set of time charts of drive signals for the display area of FIG. 11.

FIG. 12 is a set of time charts of the drive signals of FIG. 11.

The i-th gate drive signal Gi appears as an i-th scan pulse VGi (not shown for i>3). The scan pulses arise in a well known line sequencing manner, and each have a high voltage level of +20V in an active state thereof and a low voltage level of −5V in an inactive state thereof.

In each 1H duration of the scan pulse, each pixel in an associated row is driven. An infinite series of frames Fk (not shown for k>3) are each defined by and between a rising edge of a first scan pulse VG1 in a certain occurrence thereof and that in a subsequent occurrence thereto.

The j-th source drive signal Sj appears as a j-th image signal VSj (not shown for j>2). The image signals each have a transient voltage level representative of a processed image data for the liquid crystal, substantially within a range of 0V to +10V, i.e., 5V±5V. The image data may comprise a chromatic or monochromatic data and a luminance data which may include a gray background component.

A common reference voltage VCOM of approx. 5V is applied to the opposite electrode 7. With respect to the reference voltage VCOM, the level of a j+1-th image signal $VS_{j+1}$ in any 1H duration is reversed in polarity from that of the j-th image signal VSj in the 1H duration.

Moreover, the j-th image signal VSj has the polarity thereof reversed at intervals of a 2H duration that corresponds to a sum of the respective 1H durations of first and second scan pulses VG1 and VG2.

Further, between any pair of adjacent frames, the level of a j-th image signal VSj at an i-th 1H duration in either frame is reversed in polarity from that of the j-th image signal VSj at an i-th 1H duration in the other frame.

Referring again to FIG. 10, the input signal Is includes necessary signals such as an original image signal and a synchronizing signal consisting of clocks. The signal processor 9 processes them to generate a set of corresponding signals including a gate driver control signal, a source driver control signal and N image signals VS1 to $VS_N$ with their polarities determined. These signals are selectively output to the gate driver 10, as the control signal D0 which includes the gate driver control signal, and to the source driver 11, as the control signal D1 which includes the source driver control signal and the N image signals. The N image signals may be additionally processed or polarity reversed for a phase control at the source driver 11. The gate driver control signal may include any of M scan pulses.

The gate driver 10 responds to the control signal D0 to sequentially output M scan pulses VG1 to $VG_M$, in a synchronized manner. The source driver 11 responds to the control signal D1 to output the N image signals VS1 to $VS_N$ in parallel and in a synchronized manner.

Referring again to FIGS. 11 and 12, as an i-th scan pulse VGi on an i-th gate line 1 becomes active at an i-th 1H duration in a k-th frame Fk, the TFT 4 of each pixel P(i,j) in the i-th row turns on. In synchronism therewith, N image signals VS1 to $VS_N$ prepared for the i-th 1H duration in the frame Fk are applied to the N source lines, to be stored or written in the pixel P(i,j) in the same manner as the circuit of FIG. 2.

Figure 2:
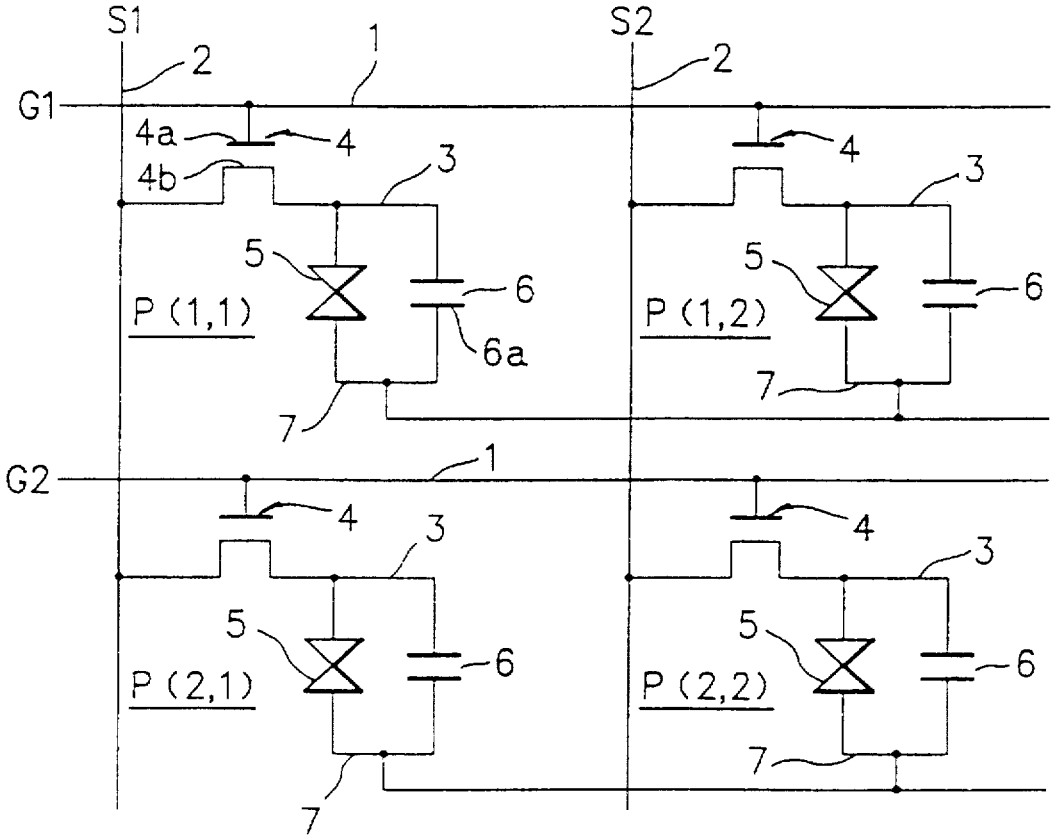
FIG. 2 PRIOR ART
FIG. 2 is a circuit diagram of a display area of an LCD panel of the display of FIG. 1.
Figure 3:
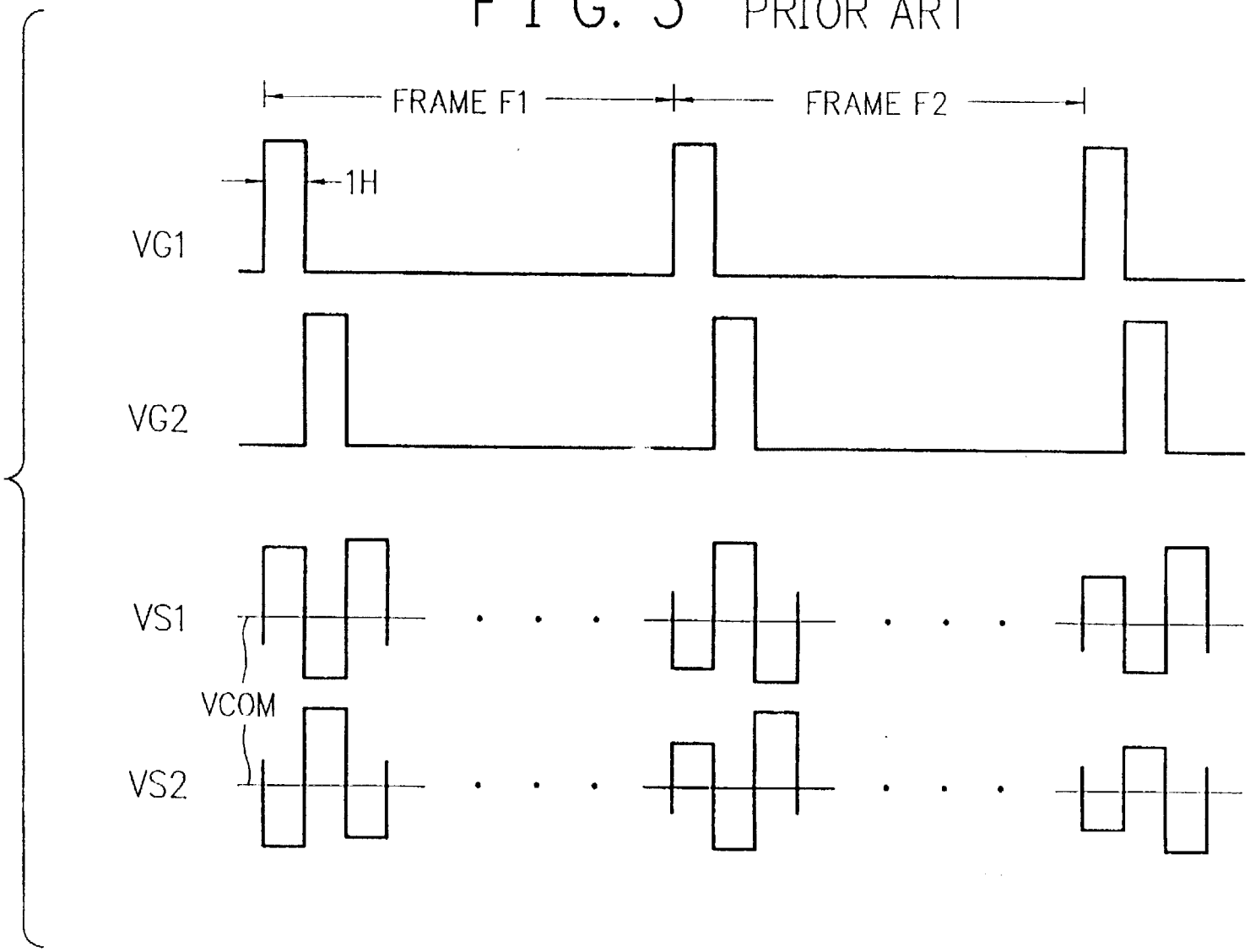
FIG. 3 PRIOR ART
FIG. 3 is a set of time charts of drive signals for the display area of FIG. 2.
Figure 4A:
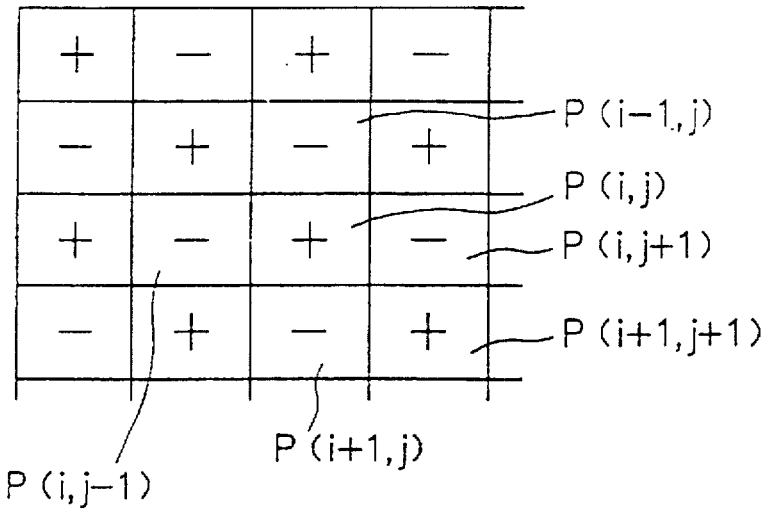
FIG. 4A PRIOR ART
FIGS. 4A and 4B are polarity maps of a display area of another conventional liquid crystal display, respectively.
Figure 4B:
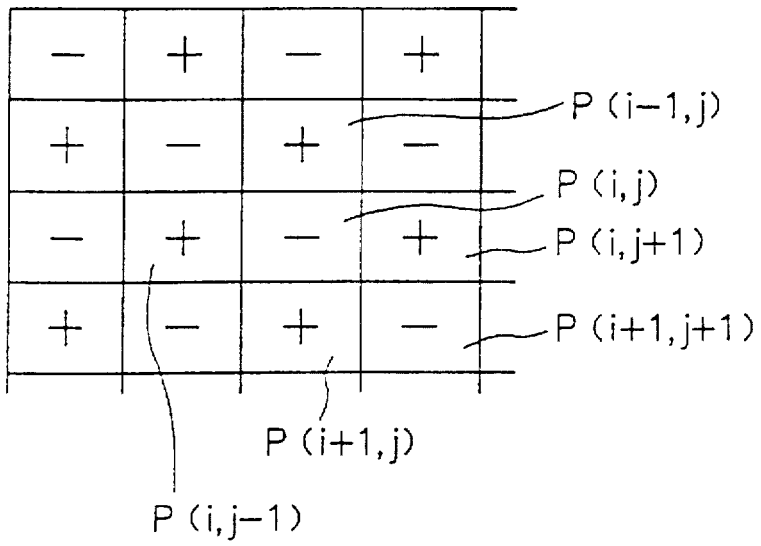
FIG. 4B PRIOR ART
Figure 5:
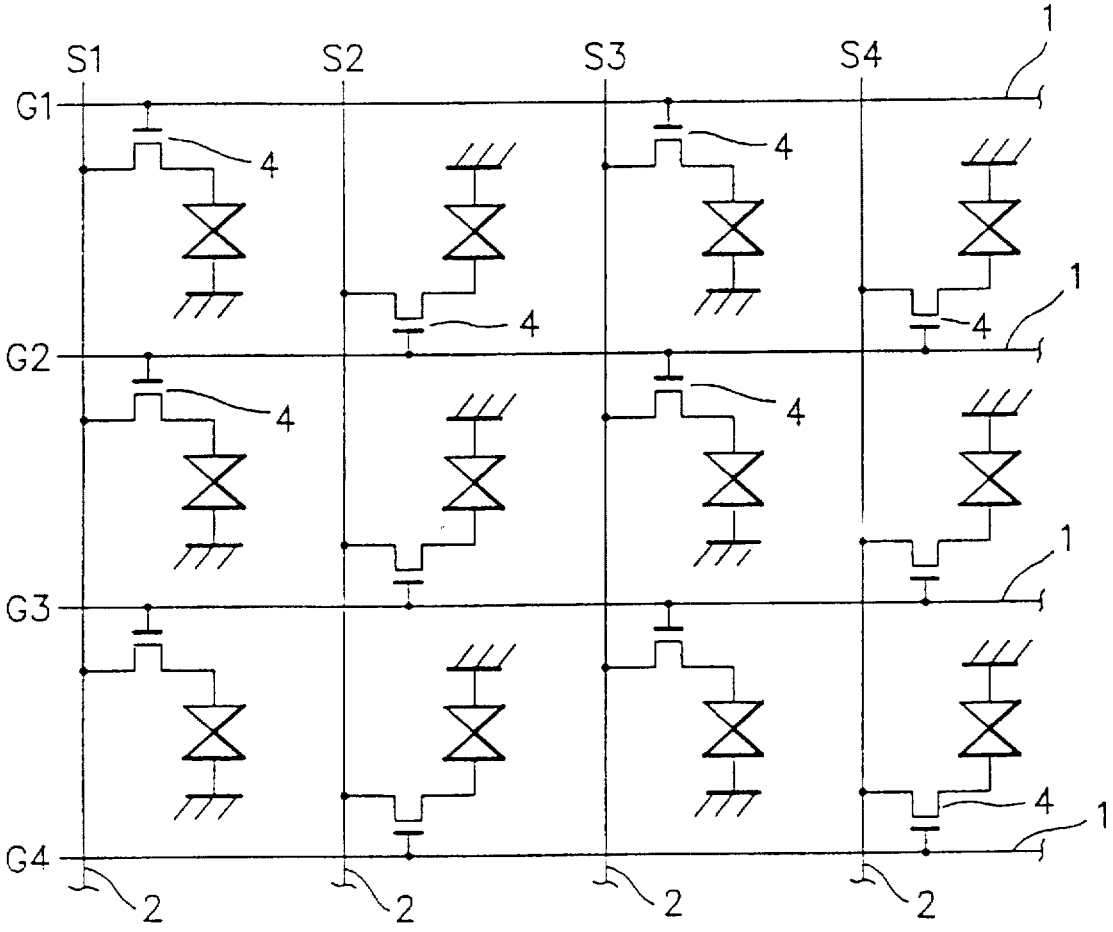
FIG. 5 PRIOR ART
FIG. 5 is a circuit diagram of a display area of another conventional liquid crystal display.

As the scan pulse VGi becomes inactive, the TFT 4 of each pixel P(i,j) in the i-th row turns off, keeping an LVC, which exerts an electric effect onto the liquid crystal with a similar result to the case of the circuit of FIG. 2.

At an i-th 1H duration in a k+1-th frame Fk+1, as the scan pulse VGi again becomes active, each pixel P(i,j) in the i-th row has a corresponding one VSj of current N image signals written therein with an equivalent potential VLC reversed in polarity from the previous potential.

Like this, each written image signal VSj has a polarity thereof alternately reversed every frame, driving an associated liquid crystal in an alternating current driven manner to thereby secure a long service life.

FIGS. 13A and 13B are polarity maps of a display area of the LCD panel 8, in the first and second frames F1 and F2, respectively.

As shown in FIG. 13A for the frame F1, an arbitrary pair of neighboring pixels P(i,j) and P(i, j+1) in a row direction of the pixel matrix have their polarities reversed to each other. In a column direction of the pixel matrix, however, a pixel P(2s−1, j) at a 2s−1-th row in a j-th column has the same polarity as a pixel P(2s, j) at a 2s-th row in the j-th column. The pixels P(2s−1, j) and P(2s, j) will be called "pixel pair". In the present embodiment, an arbitrary pair of neighboring pixel pair in the column direction have their polarities reversed to each other.

Then, in the second frame F2, as shown in FIG. 13B, each pixel has a reversed polarity.

In the embodiment also, the polarity reversion between a pair of neighboring source lines does not need a charge transfer from either of an associated pair of neighboring pixels to another beyond the other. Accordingly, charge transfers are substantially counterbalanced in the entirety of an LCD panel, without causing a horizontal crosstalk.

Moreover, in the embodiment in which a pair of image signals opposite in polarity to each other are applied to any pair of neighboring pixels in a row direction, each pixel has a flicker thereof geometrically offset by flicker components of neighboring pixels and hence the flicker is inconspicuous.

Further, in the embodiment in which a charge transfer is limited substantially between neighboring pixels, the common electrode has a reduced tendency to discharge to external circuitry, thus permitting a common voltage generator to be less power consumable.

Besides, in the embodiment, a polarity reversion is performed at intervals of a 2H duration to achieve an increased reduction of power dissipation such as at a signal processor and a source driver.

In this concern, an experiment showed a 1.0 W power consumption for a conventional signal processor, and a 0.8 W power consumption for a signal processor in a liquid crystal display according to the invention. An effective reduction was thus achieved.

Figure 14:
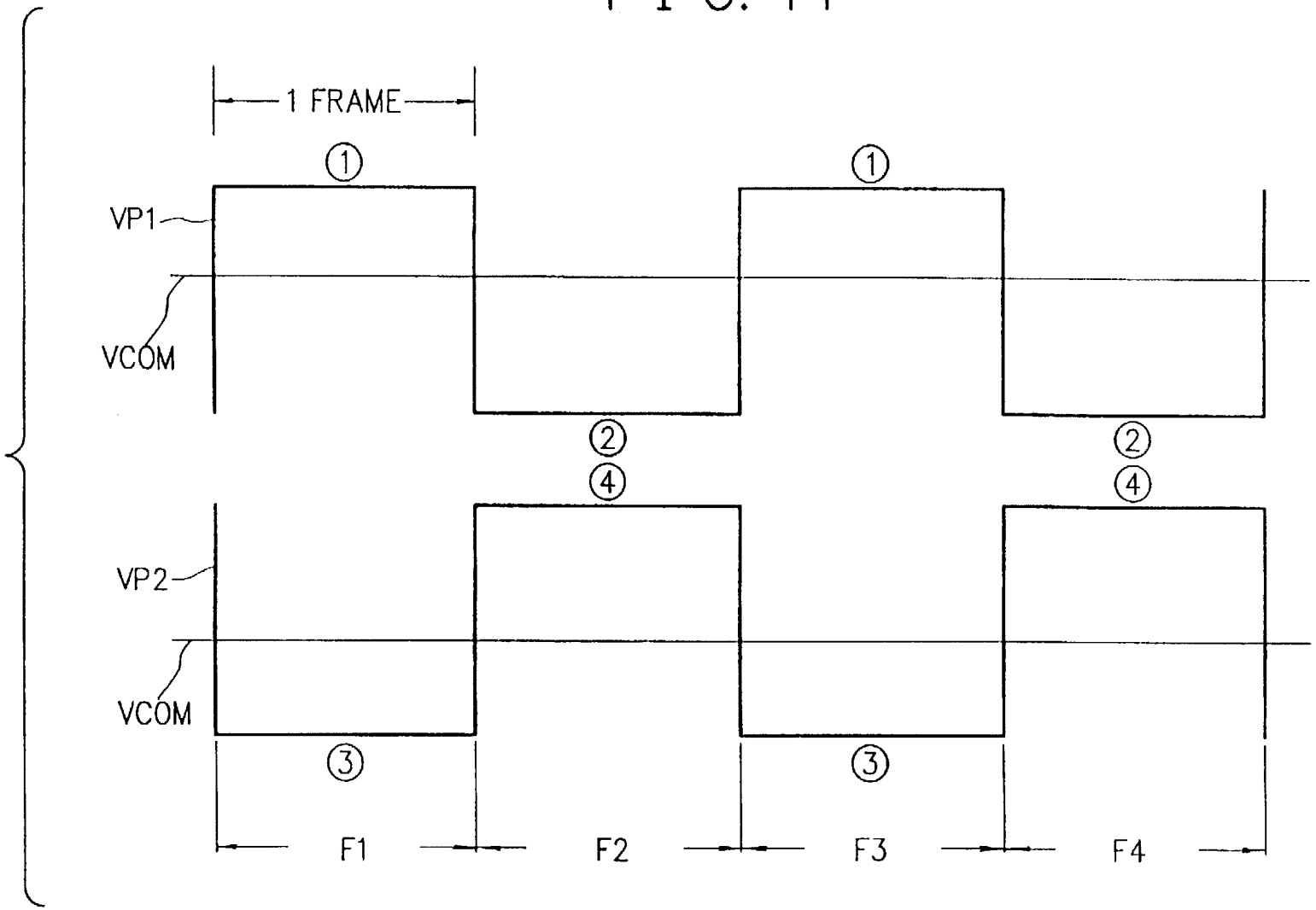
FIG. 14 is a set of time charts of drive signals for an FRC according to another embodiment of the invention.

FIG. 14 is a set of time charts of first and second ones of N parallel drive signals VP1 to $VP_N$ for an FRC of an M×N pixel matrix according to another embodiment of the invention in which the circuit of FIG. 11 is employed.

As shown in FIG. 14, each drive signal has a temporary voltage level representing either of a pair of alternately selectable different luminances, with an associated polarity relative to a reference voltage VCOM.

Figure 6:
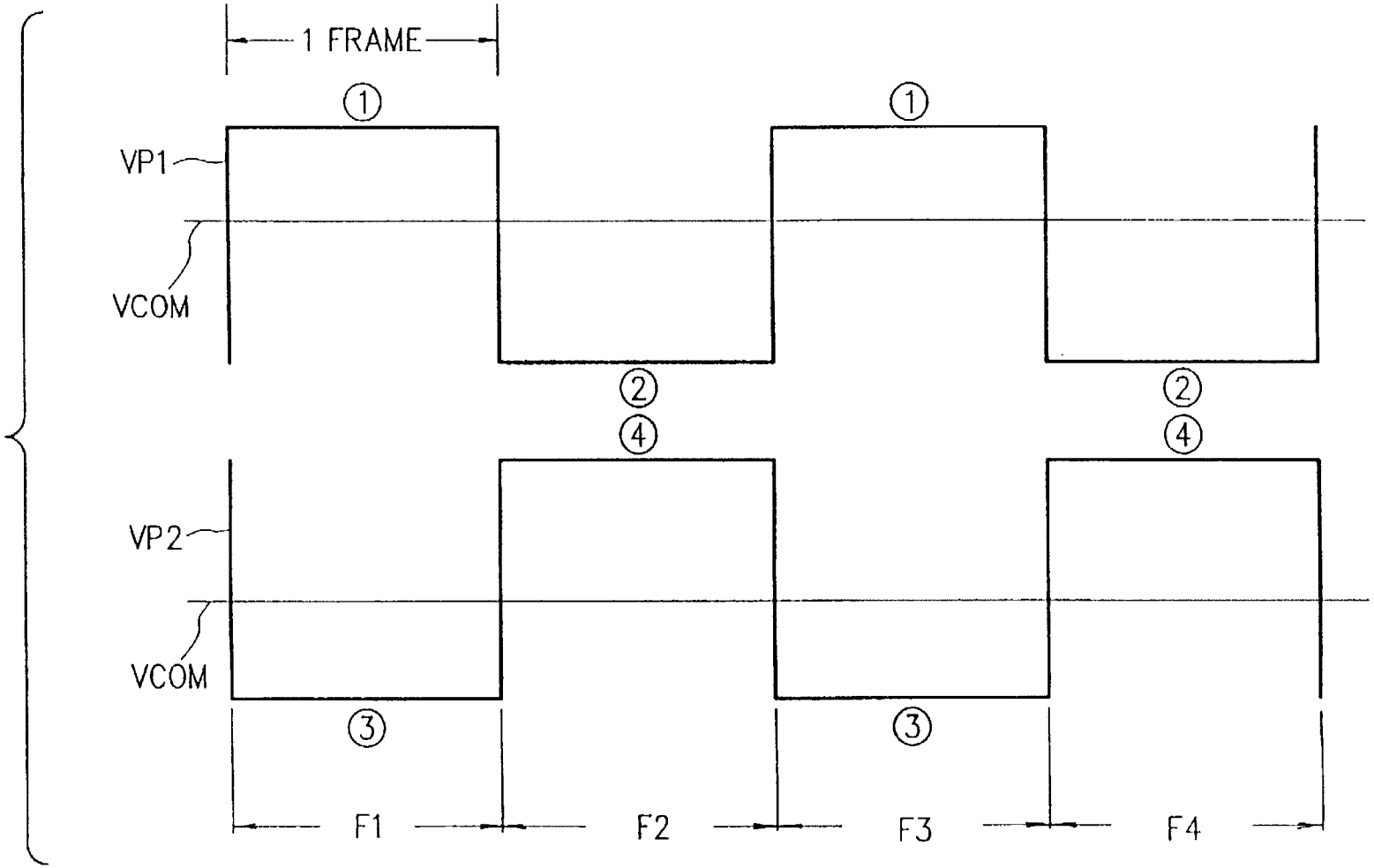
FIG. 6 PRIOR ART
FIG. 6 is a set of time charts of drive signals for a conventional FRC.
Figure 7A:
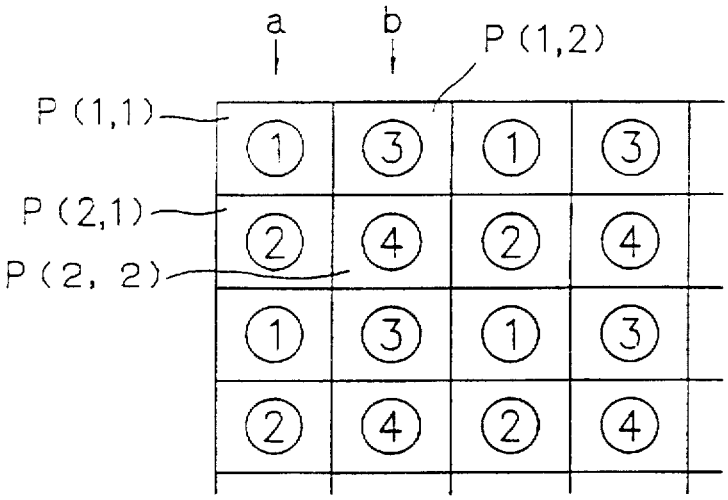
FIG. 7A PRIOR ART
FIGS. 7A and 7B are phase distribution maps on a display area in the FRC by the drive signals of FIG. 6, respectively.
Figure 7B:
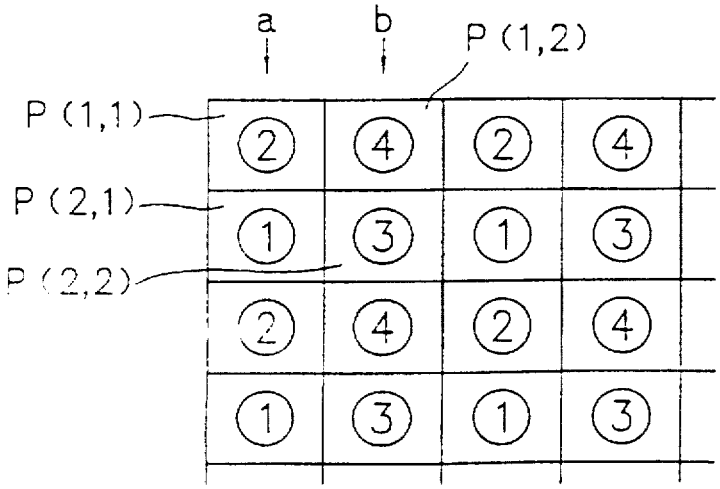
FIG. 7B PRIOR ART
Figure 8:
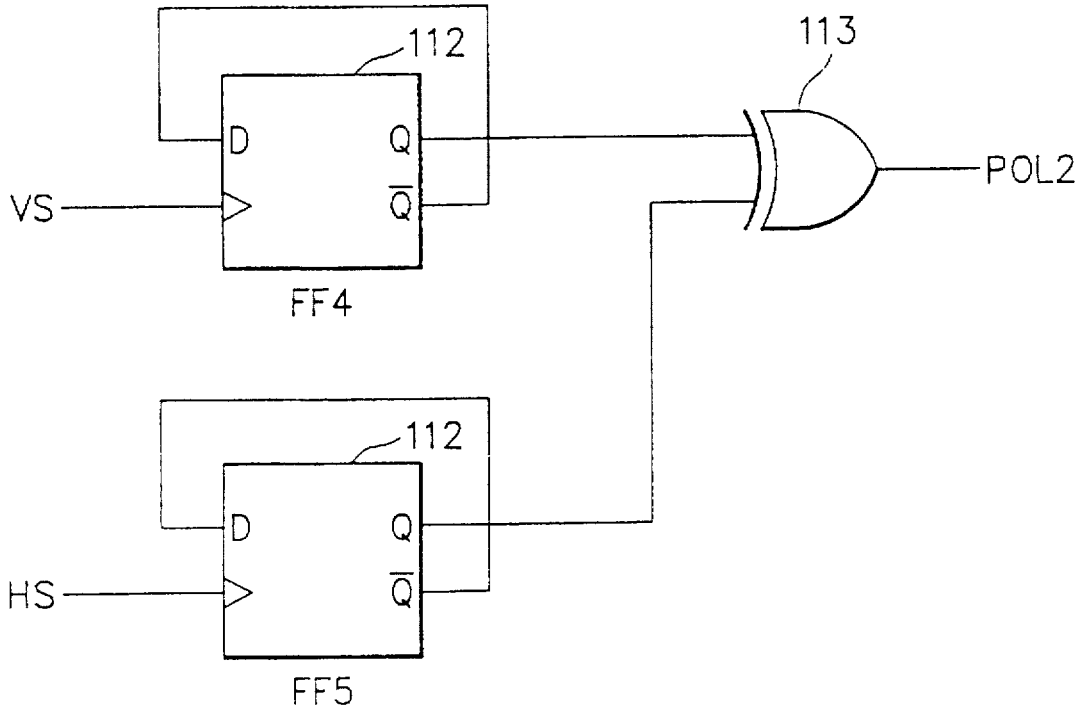
FIG. 8 PRIOR ART
FIG. 8 is a schematic circuit diagram of a conventional polarity signal generator applicable to a phase control of the drive signals of FIG. 6.
Figure 9:
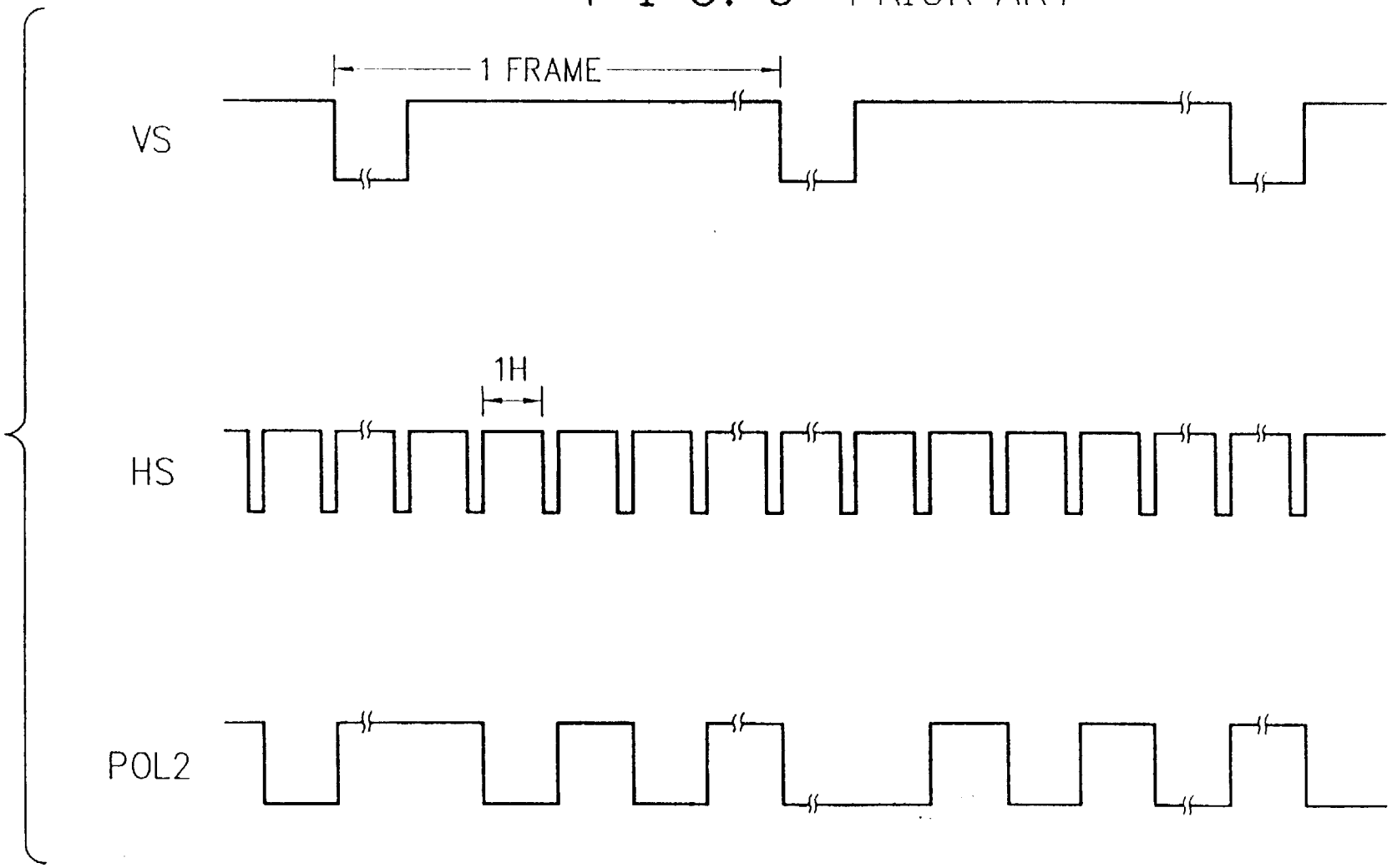
FIG. 9 PRIOR ART
FIG. 9 is a set of time charts of principal signals of the signal generator of FIG. 8.

In the N drive signals, each 2s−1-th drive signal $VP_{2s-1}$ (not shown for s>1) comprises the first drive signal VP1 of FIG. 6, and each 2s-th drive signal $VP_{2s}$ (not shown for s>1) comprises the second drive signal VP2 of FIG. 6.

Each drive signal $VP_{2s-1}$ (or $VP_{2s}$) is polarity reversible and hence phase-reversible by applying a polarity signal so that first and second phases ① and ② of the signal $VP_{2s-1}$ (or first and second phases ③ and ④ of the signal $VP_{2s}$) are replaced with each other.

The N drive signals are applied so that the first and second drive signals VP1 and VP2 are mixed and the four phases ① to ④ are additionally mixed to effectively remove flicker components.

Figure 15A:
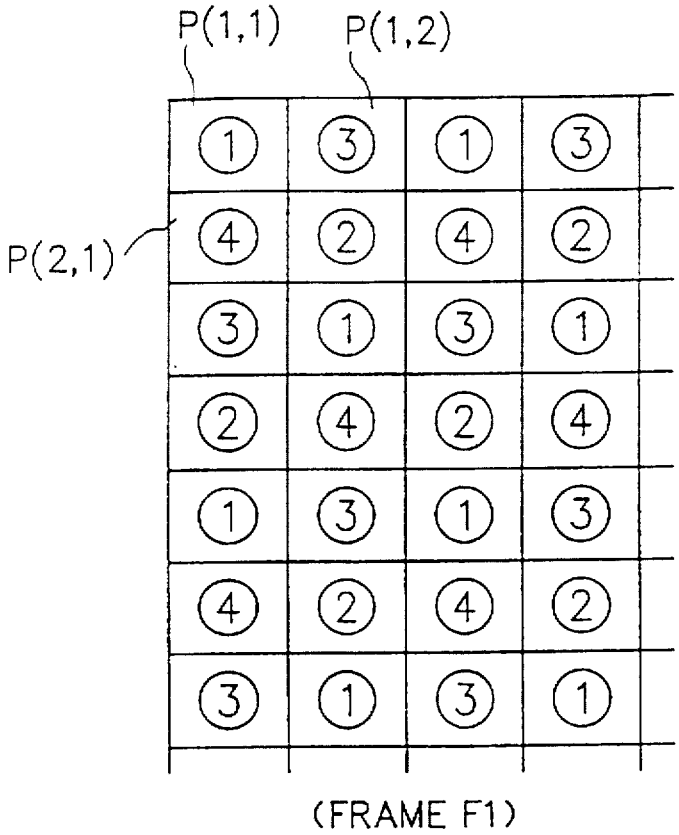
FIGS. 15A and 15B are phase distribution maps on a display area in the FRC by the drive signals of FIG. 14, respectively.
Figure 15B:
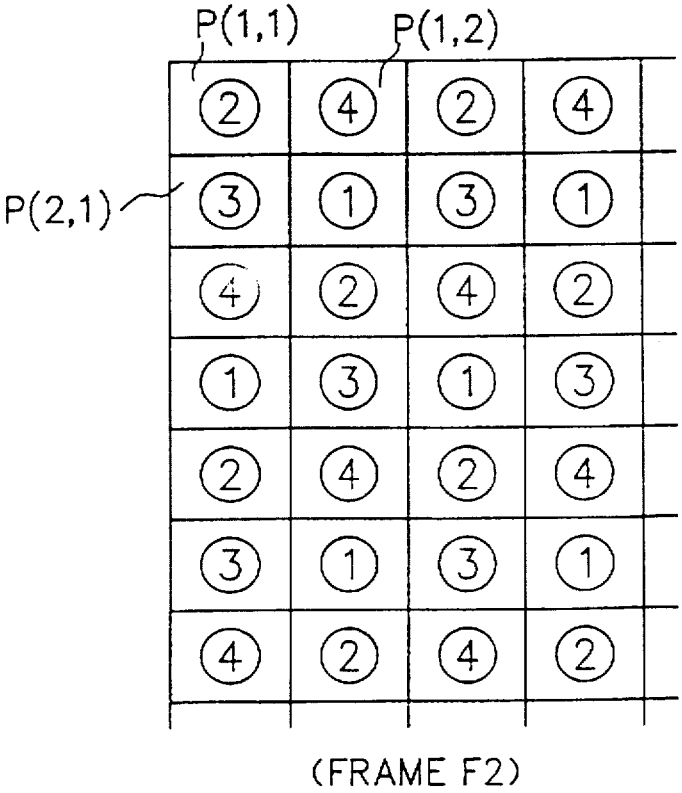

FIGS. 15A and 15B show a phase distribution map on a display area in the FRC by the drive signals of FIG. 14, for the first and second frames F1 and F2, respectively.

As shown in FIG. 15A for the first frame F1, the N drive signals ordered in parallel, as they are numbered from the first to an N-th, are phase-controlled by the polarity signal and applied via N source lines, in synchronism with sequential M scan pulses supplied to M gate lines so that, in a first 1H duration of the frame F1, each odd numbered pixel P(1, 2s−1) (not shown for s>2) in a first row has a VLC corresponding to the first phase ① of the 2s−1-th drive signal $VP_{2s-1}$ and each even numbered pixel P(1, 2s) (not shown for s>2) in the first row has a VLC corresponding to the second phase ② of the 2s-th drive signal $VP_{2s}$. In a second 1H duration of the frame F1, the N drive signals are phase-reversed and mixed so that each odd numbered pixel P(2, 2s−1) (not shown for s>2) in a second row has a VLC corresponding to the second phase ④ of the signal $VP_{2s}$ and each even numbered pixel P(2, 2s) (not shown for s>2) in the second row has a VLC corresponding to the second phase ② of the signal $VP_{2s-1}$.

In a third 1H duration of the frame F1, the N drive signals are phase-controlled and mixed so that each odd numbered pixel P(2, 2s−1) (not shown for s>2) in a third row has a VLC corresponding to the first phase ③ of the signal $VP_{2s}$ and each even numbered pixel P(2, 2s) (not shown for s>2) in the third row has a VLC corresponding to the first phase ① of the signal $VP_{2s-1}$.

In a fourth 1H duration of the frame F1, the N drive signals are phase-reversed so that each odd numbered pixel P(2, 2s−1) (not shown for s>2) in a fourth row has a VLC corresponding to the second phase ② of the signal $VP_{2-1}$ and each even numbered pixel P(2, 2s) (not shown for s>2) in the fourth row has a VLC corresponding to the second phase ④ of the signal $VP_{2s}$.

As shown in FIG. 15B, in a first 1H duration of the second frame F2, the phase-controlled N drive signals are applied so that the odd numbered pixel P(1, 2s−1) in the first row has a VLC corresponding to the second phase ② of the signal $VP_{2s-1}$ and the even numbered pixel P(1, 2s) in the first row has a VLC corresponding to the second phase ④ of the signal $VP_{2s}$.

In a second 1H duration of the frame F2, the N drive signals as polarity-reversed are supplied so that the pixel P(2, 2s−1) has a VLC corresponding to the first phase ① of the signal $VP_{2s-1}$ and the pixel P(2, 2s) has a VLC corresponding to the first phase ③ of the signal $VP_{2s}$.

In a second, a third and a fourth 1H duration of the second frame F2, a phase-reversion or control and/or signal mixing is performed in the same manner as the second, the third and the fourth 1H duration of the first frame F1, respectively.

For a 4t−3-th row, the same control as the first row is performed in any frame, where t is an arbitrary positive integer. For a 4t−2-th, 4t−1-th and 4t-th row, the same control as the second, the third and the fourth row is performed, respectively.

In a 2s−1-th 1H duration of an arbitrary frame Fk, a 2s−1-th row of the pixel matrix has the same phase distribution pattern as the first row. In a 2s-th 1H duration of the frame Fk, a 2s-th row of the pixel matrix has the same phase distribution pattern as the second row.

As will be seen from FIGS. 15A and 15B, any quartet of pixels within any two-row by two-column area, i.e. P(i,j), P(i, j+1), P(i+1, j) and P(i+1, j+1), include all of the four phases ① to ④, and no pair of neighboring pixels in the same row or same column are co-phased, so that flicker components of respective pixels are offset with each other to an invisible level.

Moreover, any quartet of pixels in the same row, i.e. P(i, j), P(i+1, j), P(i+2, j) and P(i+3, j), include all of the four phases ① to ④, thus permitting vertical striped shades to be effectively reduced to provide an improved display quality.

Figure 16:
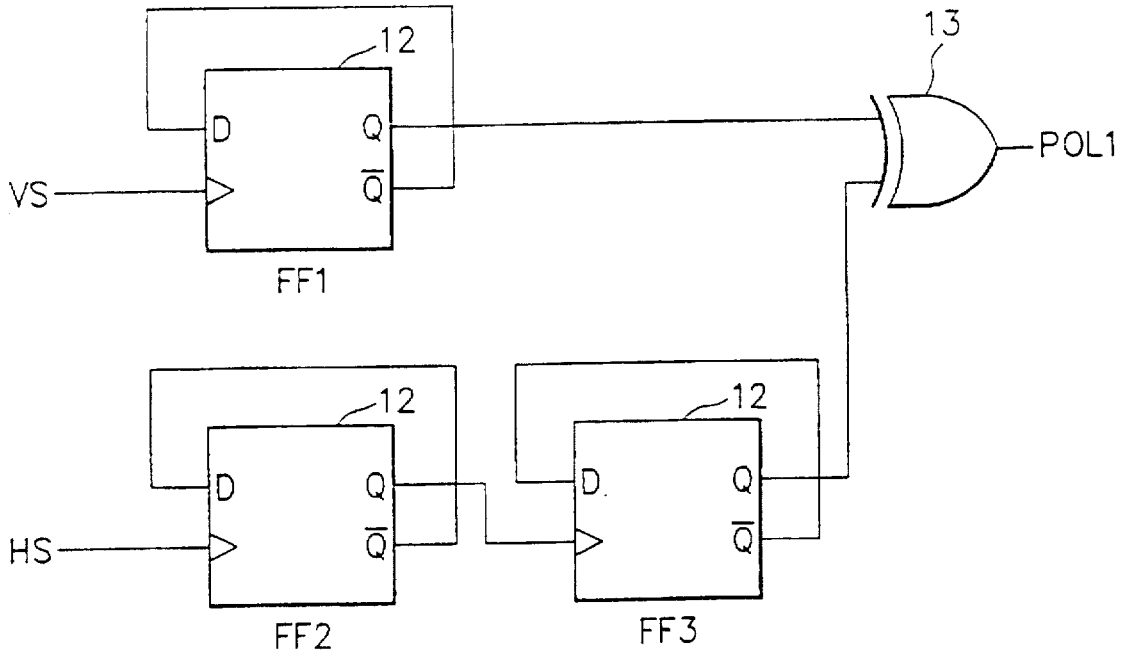
FIG. 16 is a schematic circuit diagram of a polarity signal generator applicable to a phase control of the drive signals of FIG. 14.
Figure 17:
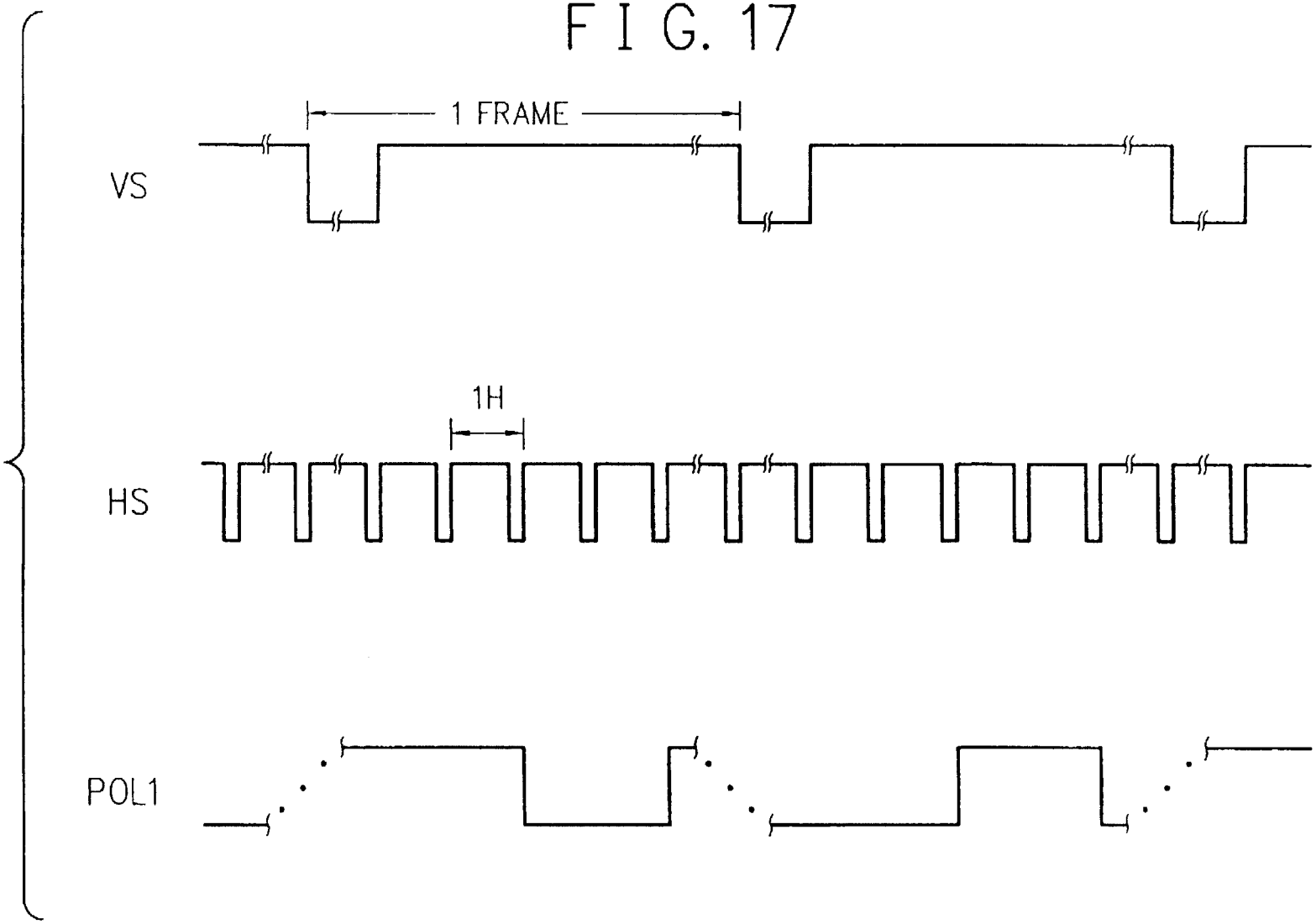
FIG. 17 is a set of time charts of principal signals of the signal generator of FIG. 16.

FIG. 16 is a schematic circuit diagram of a polarity signal generator applicable to a phase control of the drive signals of FIG. 14 in accordance with the invention, and FIG. 17 is a set of time charts describing a number of principal signals of the polarity signal generator.

The polarity signal generator comprises a triple of D-type flip-flops 12 numbered one "FF1", another "FF2" and the other "FF3" for identification, and an EXOR circuit 13.

The flip-flop FF1 halves a frequency of a frame clock employed as a vertical synchronizing pulse VS, to output a half-frequency pulse. The flip-flop FF2 halves a frequency of a line clock employed as a horizontal synchronizing pulse HS, to output another half-frequency pulse, and the flip-flop FF3 frequency-halves this half-frequency pulse to output a fourth-frequency pulse. The EXOR circuit 13 determines an EXOR between the half-frequency pulse from the FF1 and the fourth-frequency pulse from the FF3, to output a corresponding pulse signal as a polarity signal POL1 that has a polarity thereof reversed, i.e. a pair of polarity representative voltage levels alternately selected, at intervals of a 2H duration and a signal phase thereof reversed at intervals of one frame.

Incidentally, according to the embodiments, the TFT 4 made of an amorphous silicon may be formed by use of any other semiconductive material, e.g. a polycrystalline silicon.

Moreover, the 2H period of polarity reversion may effectively reduce power dissipation at both signal processor 8 and source driver 11. The reduction ratio was as large as 20% (=0.2 W/1.0 W) or near in the experiment of signal processor.

Further, in an FRC drive, four voltage patterns are uniformly distributed, thus contributing to an uniform grey background improved in display quality, in addition to the effective reduction of vertical striped shades.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A liquid crystal display, comprising:

a display comprising a matrix of pixels each having a common reference potential; and a drive means for driving the display wherein, every other one of said pixels in a row direction of the matrix are driven by a signal having a reversed polarity relative to the reference potential, and every other pair of said pixels in a column direction of the matrix are driven by said signal having a reversed polarity relative to the reference potential, and the polarity of the signal supplied to each of the pixels is reversed every frame.

2. A liquid crystal display according to claim 1, wherein the polarity of the signal is reversed depending on an exclusive logical sum between a half-frequency signal of a vertical synchronizing signal of the display and a fourth-frequency signal of a horizontal synchronizing signal of the display.

3. A liquid crystal display according to claim 1 wherein the display further comprises:

a first transparent insulating substrate member;

a second transparent insulating substrate member opposing the first substrate member;

M gate lines arranged in parallel with each other on the first substrate member, where M is a predetermined positive integer;

N source lines arranged in parallel with each other on the first substrate member, where N is a predetermined positive integer;

the M gate lines and the N source lines crossing with each other in an electrically isolated manner and cooperating with each other to have therebetween M×N cross points and to define therebetween M×N enclosed areas associated with the M×N cross points in a one to one corresponding manner where the matrix of pixels has M rows and N columns;

the pixels each comprising:

a thin film transistor formed in a vicinity of one of the M×N cross points;

a pixel electrode formed in one of the M×N enclosed areas corresponding to said one of the M×N cross points;

the pixel electrode being chargeable to have the signal potential developed thereon;

an opposite electrode formed on the second substrate member;

the opposite electrode being charged to have a reference potential developed thereon; and a liquid crystal filled between the first and second substrate members;

the liquid crystal being responsive to the signal potential.

4. A liquid crystal display according to claim 3, wherein the thin film transistor is made of one of amorphous silicon and crystalline silicon.

5. A liquid crystal display, comprising:

a display comprising a matrix of pixels each having a common reference potential developed therein; and a drive means for driving the display so that the pixels are each respectively supplied with alternately selected one of a first drive voltage and a second drive voltage, said first drive voltage having a pair of drive phases, said pair comprising a relatively small voltage with a positive polarity relative to the reference voltage and a relatively large voltage with a negative polarity relative to the reference voltage, and said second drive voltage having a pair of drive phases, comprising the relatively small voltage with the negative polarity and the relatively large voltage with the positive polarity to thereby display an intermediate tone, wherein four of the pixels in an arbitrary two-row by two-column area of the matrix and four of the pixels in an arbitrary quartet of continuous rows in an arbitrary column of the matrix both contain the first drive voltage and the second drive voltage.

6. A liquid crystal display according to claim 5 wherein any pair of neighboring ones of the pixels in an arbitrary row or an arbitrary column of the matrix contain a different two of the drive phases of the first drive voltage and the drive phases of the second drive voltage.

7. A liquid crystal display according to claim 5, wherein an arbitrary pair of neighboring ones of the pixels in an arbitrary row of the matrix are driven by one of the first drive voltage with either of the positive and negative polarities and the other pixel in said pair by the second drive voltage with the other of said positive and negative polarities, wherein an arbitrary pair of neighboring pairs of the pixels in an arbitrary column of the matrix are driven either by one of the first and second drive voltages with either of the positive and negative polarities and the other pair by said one of the first and second drive voltages with the other of said positive and negative polarities, and wherein the polarities of the drive voltages to each of said pixels is reversed every frame.

8. A control method for driving a liquid crystal display including a display comprising a matrix of pixels, comprising the steps of:

developing a common reference potential in each of the pixels;

driving the display in a row direction so that every other pixel in the row direction of the matrix is driven by a signal having a reversed polarity relative to the reference potential;

driving the display in a column direction wherein every other pair of pixels in the column direction of the matrix are driven by a signal having a reversed polarity relative to the reference potential; and reversing the polarity of the signal potential in each of the pixels every frame.

9. A control method according to claim 8, further comprising a step of reversing the polarity of the signal potential depending on an exclusive logical sum between a half-frequency signal of a vertical synchronizing signal of the display and a fourth-frequency signal of a horizontal synchronizing signal of the display.

10. A control method for driving a liquid crystal display including a display comprising a matrix of pixels, comprising the steps of:

developing a common reference potential in each of the pixels;

providing a first drive voltage comprising a pair of drive phases comprising one of a small voltage with a positive polarity relative to the reference potential and a large voltage with a negative polarity relative to the reference potential;

providing a second drive voltage having a pair of drive phases comprising one of the small voltage with the negative polarity relative to the reference potential and the other with the large voltage with the positive polarity relative to the reference potential to thereby display an intermediate tone, wherein four of the pixels in an arbitrary two-row by two-column area of the matrix and four of the pixels in an arbitrary quartet of continuous rows in an arbitrary column of the matrix both contain both the pair of drive phases of the first drive voltage and the pair of drive phases of the second drive voltage.

11. A control method according to claim 10, wherein any pair of neighboring ones of the pixels in an arbitrary row or an arbitrary column of the matrix contain a different two of the drive phases of the first drive voltage and the drive phases of the second drive voltage.

12. A control method according to claim 10 wherein neighboring ones of the pixels in an arbitrary row of the matrix are driven either by the first drive voltage with one of the positive and negative polarities and the other by the second drive voltage with the other of the positive and negative polarities, wherein neighboring pairs of the pixels in an arbitrary column of the matrix are driven by one of the first and second drive voltages with one of the positive and negative polarities and the other pair by one of the first and second drive voltages with the other of the positive and negative polarities, and wherein the positive and negative polarities driving the pixels are reversed every frame.

13. A method of driving a matrix of pixels in a display device, comprising steps of:

providing a common reference potential for each of said pixels;

in a first frame:

driving every other one of said pixels in a row direction of said matrix with a positive polarity drive signal with respect to said common reference potential, and driving remaining ones of said pixels in said row direction with a negative polarity drive signal with respect to said common reference potential; and driving every other pair of pixels in a column direction of said matrix with a positive polarity drive signal with respect to said common reference potential, and driving remaining pairs of said pixels with a negative polarity drive signal with respect to said common reference potential; and in a second frame:

reversing the polarities of the drive signals driving each of said pixels in said matrix with respect to the polarities in said first frame.

14. A method of driving a matrix of pixels in a display device as recited in claim 13 wherein said step of reversing the polarities of the drive signals comprises calculating an exclusive logical sum between a half-frequency signal of a vertical synchronizing signal of the display and a fourth-frequency signal of a horizontal synchronizing signal of the display device.

15. A method of driving a matrix of pixels in a display device, comprising steps of:

providing four phased drive signals;

driving every quartet of said pixels in a first two rows and every other two rows thereafter of said matrix with a first combination of said four phased drive signals; and driving a second quartet of pixels in a second two rows and every other two rows thereafter of said matrix with a second combination of said four phased drive signals, wherein said four phased drive signals are labeled one, two, three, four, respectively, and wherein in a first frame, said first combination comprises repeating a pattern one, three, four, two; and said second combination comprises repeating a pattern three, one, two, four.

16. A method of driving a matrix of pixels in a display device as recited in claim 15, further comprising the steps:

in a second frame, switching said four phased drive signals to drive diagonal pixels in said quartets of pixels wherein said first combination comprises repeating pattern two, four, three, one; and wherein said second combination comprises repeating pattern four, two, one, three.

* * * * *